US006945797B2

(12) United States Patent
Obara

(10) Patent No.: US 6,945,797 B2
(45) Date of Patent: Sep. 20, 2005

(54) CARD ELECTRICAL CONNECTOR APPARATUS

(75) Inventor: Syu Obara, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/865,911

(22) Filed: Jun. 14, 2004

(65) Prior Publication Data

US 2004/0253858 A1 Dec. 16, 2004

(30) Foreign Application Priority Data

Jun. 11, 2003 (JP) ..... 2003-166669

(51) Int. Cl.[7] ..... H01R 13/44

(52) U.S. Cl. ..... 439/133; 439/157; 439/325; 361/684

(58) Field of Search ..... 439/133, 157–159, 439/325–328; 361/684

(56) References Cited

U.S. PATENT DOCUMENTS 5,470,241 A * 11/1995 Kaufman et al. ..... 439/159
5,793,607 A * 8/1998 Karidis et al. ..... 361/684
6,129,572 A * 10/2000 Feldman et al. ..... 439/328
6,272,017 B1 * 8/2001 Klatt et al. ..... 361/737

FOREIGN PATENT DOCUMENTS

JP 3095337 8/2000

* cited by examiner

*Primary Examiner*—Truc Nguyen
(74) *Attorney, Agent, or Firm*—Takeuchi & Takeuchi

(57) ABSTRACT

A card electrical connector apparatus (10) includes a connector section (40) connectable to a card (C) at a right angle with respect to a card insertion direction when the card is inserted completely into an electronics device through a receiving slot (12); a driving section (50) linked to the connector section for moving the connector section (40); and an operation section (37, 56) for operating the driving section from outside. The operation section (37, 56) movable between a first position where the card is allowed to be removed and a second position where removal of the card is either impossible or difficult. When the operation section (37, 56) is at the first position, the driving section (50) moves the connector section (40) to the release position.

9 Claims, 6 Drawing Sheets

CARD ELECTRICAL CONNECTOR APPARATUS

BACKGROUND OF THE INVENTION

1. Field of the Invention

The present invention relates to electrical connector apparatuses for cards and, particularly, to an electrical connector apparatus capable of preventing accidental removal of a card.

2. Description of the Related Art

Japanese Patent No. 3,095,337 discloses, in paragraphs (0039) and (0040), an electrical connector apparatus of this type. This connector apparatus is incorporated in an electronics device to receive a card, such as a PC card, through a front slot of the device so that the terminals of the card are connected to the electrical connector provided at the opposite end to the front slot.

The terminals provided on a side edge of the card are connected to an external coaxial cable. The terminals of the coaxial cable are pressed toward the side edge of the card for contact with the card terminals. To remove the card, the button of a removal lever provided in a card ejector is depressed to bring by way of a cam mechanism a retention member for holding the coaxial terminals to the spaced position against the above pressure, thereby releasing the contact of the terminals.

However, the rear end of a card projects from the front slot even before the release button is depressed so that the rear end of the card can be grabbed accidentally to remove the card. To protect the cable terminals from damage at such an accident, cable terminals cannot be connected by fitting to the card terminals but only brought into contact with them. The electrical connection by this surface contact, however, can cause poor conduction under vibrations.

SUMMARY OF THE INVENTION

Accordingly, it is an object of the invention to provide a card electrical connector apparatus for securing connection between card and cable terminals by fitting, thereby minimizing accidental removal of the card.

According to the invention there is provided a card electrical connector apparatus comprising a connector section connectable to a card at a right angle with respect to a card insertion direction when said card is inserted completely into an electronics device through a receiving slot. The connector section is slidable between a connection position and a release position with respect to the card. Also, it includes a driving section linked to the connector section for moving the connector and an operation section for operating the driving section from outside. The operation section is movable between a first position where the card is allowed to be removed and a second position where removal of the card is either impossible or difficult. When the operation section is at the first position, the driving section moves the connector section to the release position.

Only when the operation section is moved to the first position, the driving section moves the connector section from the connection position to the release position, thereby bringing the card to such a position that the card can be pulled out. At this point, the connector is at the release position so that the card can be removed without any difficulty. For the connection by fitting, the fitting is released so that the card can be removed without difficulty. For the connection by contact, the terminals are spaced from the card, thus causing no friction.

It is preferred that when the operation section is at the second position, the driving section moves the connection section to the connection position. This makes it possible to connect the connector section after the card has been inserted by the operation section.

Also, it is preferred that the operation section or a part of the operation section is at such a position as to interfere with the card in a card removing direction when the operation section is at the second position. The operation section may be made to also serve as a push button for operating an ejector mechanism that ejects the card from the receiving slot. Also, the driving section may be linked to the operation section so as to make a link mechanism and includes a stopper member that interferes with an rear end of the card so that when the operation section is moved from the second position to the first position, the stopper member is moved to a non-interference position and the driving section brings the connector section to the release position. The operation section may be made integral with the driving section.

DESCRIPTION OF THE PREFERRED EMBODIMENTS

First Embodiment

Figure 1:
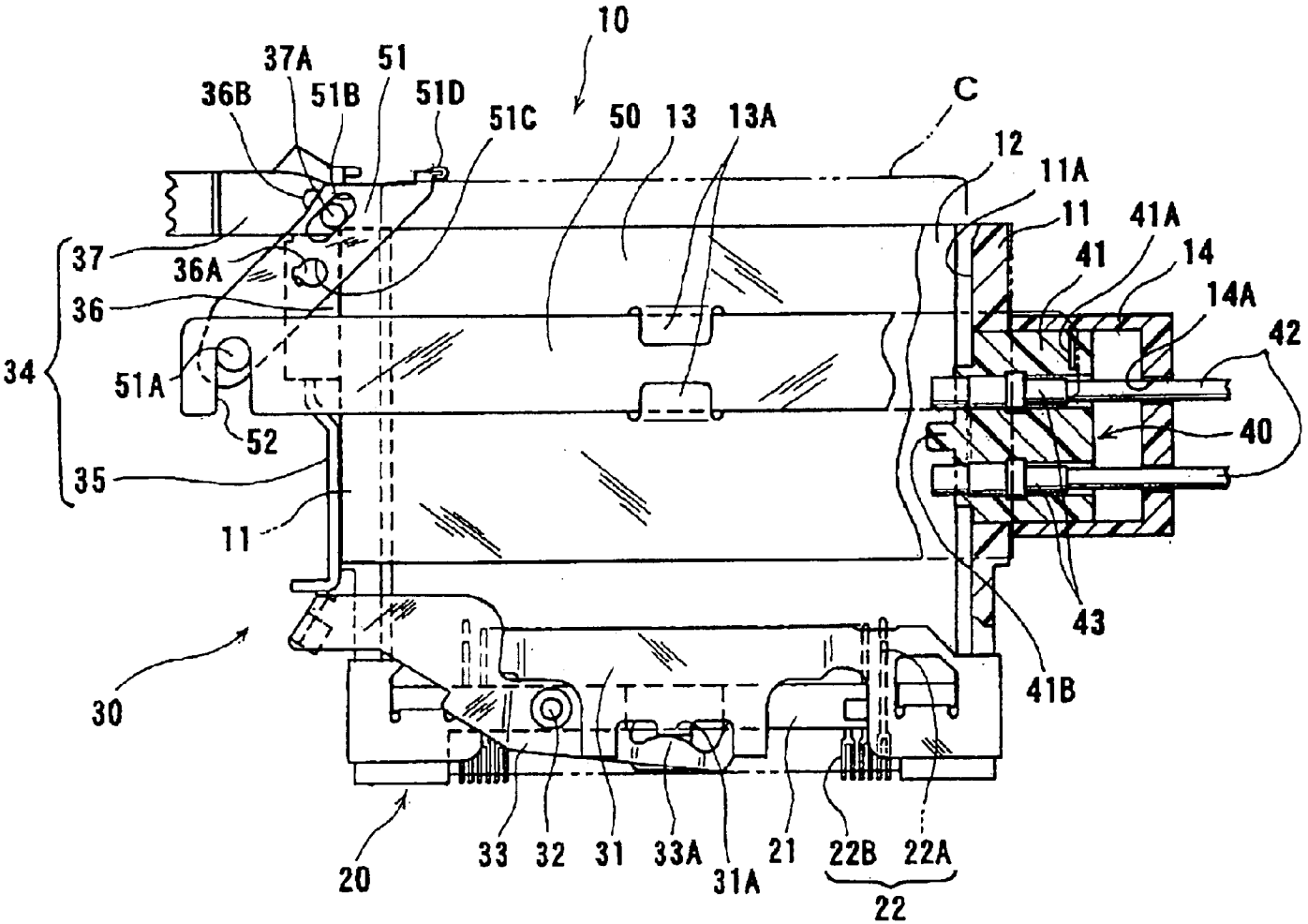
FIG. 1 is a plan view of an electrical connector apparatus according to the first embodiment of the invention under the condition that the removal operation is prohibited.

In FIG. 1, a card C extends in a plane parallel to the sheet and has a plurality of terminals arranged on the front end thereof and a coaxial connector at the right hand side edge. A circuit, etc. on the card C is connected to these terminals.

A card electrical connector apparatus 10 for receiving such a card C includes a pair of guide members 11 made of an insulating material such that each has a guiding channel 11A for guiding insertion/removal of the card C, a bottom plate 12 extending between the guide members 11, and an upper plate 13 extending between the guide members 11 in parallel to the bottom plate 12, making a thin rectangular tube. The bottom and upper plates 12 and 13 are made of a metal sheet to provide not only a structural strength but also a shield effect for the card C.

A front connector 20 is provided at the front ends of the guide members 11. The front connector 20 is supported by a housing 21 and has a plurality of terminals 22 that extend from the housing 21. Each terminal 22 has at the rear end a contact section 22A for contact with the front edge of the card C and at the front end a connection section 22B for connection to another part of the electronics device.

An ejector mechanism 30 is provided for the connector apparatus 10 to eject the card C. The ejector mechanism 30 includes a slider 31 made by bending and forming a metal sheet for sliding along the guide members 11, a lever 33 made by bending and forming a metal sheet and pivoted by a pin 32 to the slider 31 for rotation, and a push rod 34 for pushing the left end of the lever 33. The push rod 34 includes a rod section 35 for abutment with the lever 33, a base section 36 for supporting the rod section 35, and a push button 37 rotatable about an axis 36B by a predetermined angle with respect to the base section 36.

Figure 2:
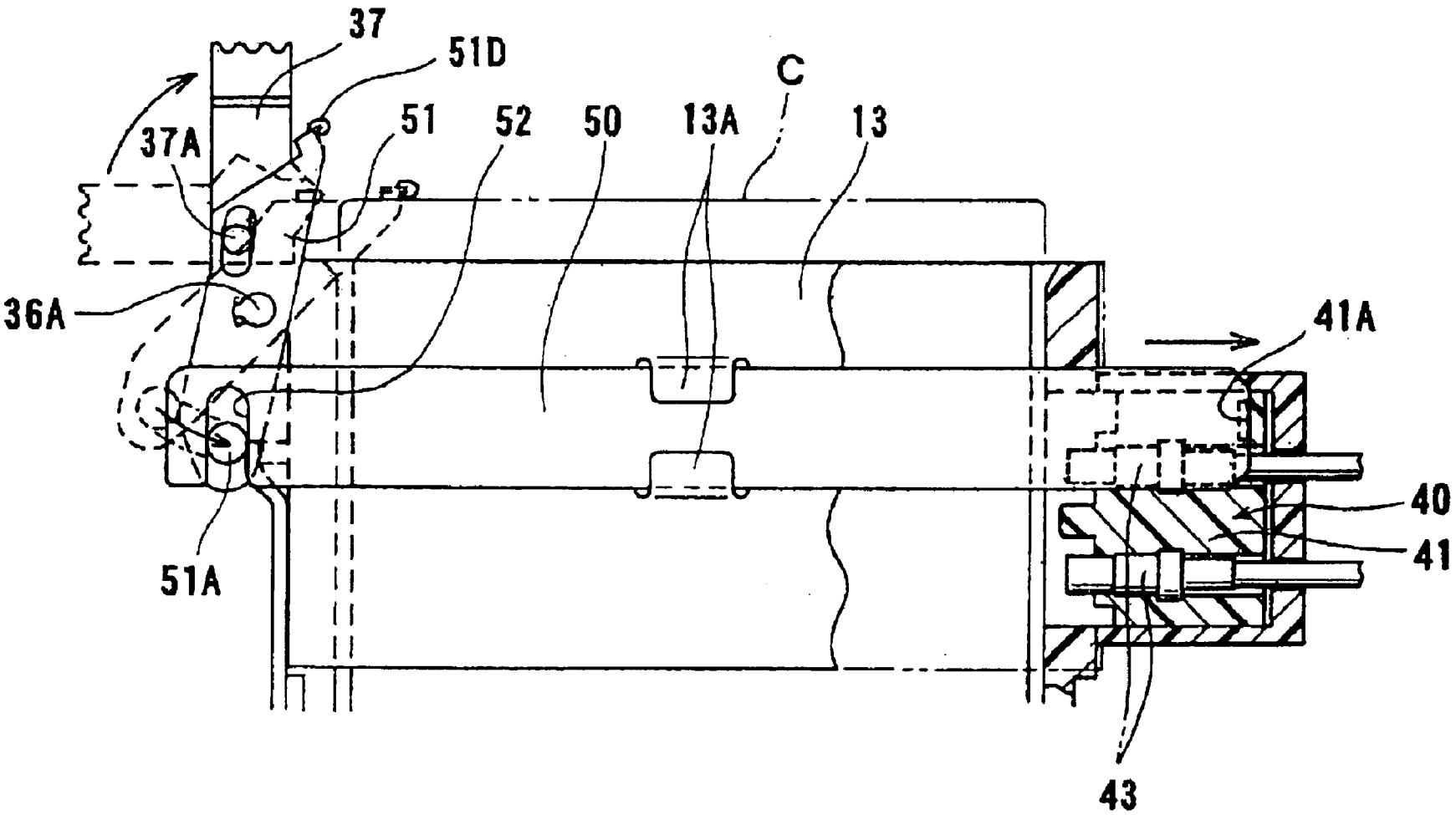
FIG. 2 is a plan view of the electrical connector apparatus under the condition that the card removal operation is permitted.

To eject the card C, the push button 37 is rotated from the second or lateral position in FIG. 1 to the first or vertical position in FIG. 2 and then depressed to push the left end of the lever 33 via the rod section 35. Consequently, the lever 33 is turned counterclockwise about pin 32 to push rearwardly the press portion 31A of the slider 31 with its abutting portion 33A. Thus, the slider 31 pushes rearwardly the card C, bringing the card C to the "front position" where the card terminals are unplugged from the contact sections 22A of the front connector 20.

A side connector 40 is provided on the guide member 11 on the right side. The side connector 40 is supported by a frame member 14, which extends laterally from an opening provided in the guide member 11, for sliding movement in the lateral direction. The side connector 40 includes a retention member 41 made of an electrically insulating material and a pair of coaxial terminals 43 supported by the retention member 41 and connected to coaxial cables 42, respectively. The retention member 41 is laterally slidable within the frame member 14. The coaxial cables 42 extend through holes 14A provided in the frame member 14. The holes 14A have a diameter sufficiently large to permit sliding of the cable 42 in sync with the sliding of the retention member 41. The coaxial terminal 43 projects from the retention member 41 into the interior. An engaging groove 41A is provided in the retention member 41 for engagement with a later described driving member. A positioning projection 41B is provided on the inner face of the retention member 41 between the coaxial terminals 43 for engagement with a corresponding recess of the card C.

The driving member 50 is made of a strip of metal sheet and engages at the right end with the retention member 41 and at the left end with an intermediate link 51 such that the intermediate link 51 is rotatable. More specifically, the driving member 50 has at the right end a claw that is press fitted into the engaging groove 41A of the retention member 41 to secure itself to the retention member 41. The driving member 50 is supported by the upper plate 13 with a raised section 13A for lateral movement. A U-shaped recess 52 is provided at the left end of the driving member 50 to engage with the intermediate link 51 at an axis 51A. An elongated hole 51B is provided at the other end of the intermediate link 51 to engage with the push button 37 at an axis 37A for rotation. The intermediate link 51 engages with the rod section 35 at the axis 36A with an aperture 51C. The axis 36A has a projection on its circumferential surface to prevent separation of the intermediate link 51. A stopper claw 51D extends to the right from the intermediate member 51. The rod section 35, the base section 36, the push button 37, which constitute the push rod 34, and the driving member 50 constitute a link mechanism.

How to eject a card will be described below.

(1) Under the condition of FIG. 1, the card C is inserted up to the regular position so that it is plugged or connected by fitting to, at its front end, the front connector 20 and, at its side edge, to the side connector 40. The stopper member 51D is in the vicinity of the rear end of the card C to prevent accidental removal of the card C.

(2) As shown in FIG. 2, the push button 37 is turned from the second or lateral position shown by broken line to the first or vertical position shown by solid line, the axis 37A of the push button 37 is turned clockwise about the axis 36B to the left.

(3) Consequently, the intermediate link 51 is turned counterclockwise about the axis 36A, bringing the stopper member 51D out of the width of the card C.

(4) The intermediate link 51, which engages with the driving member 50 with the axis 51A at the recess 52, pushes the driving member 50 to the right with the axis 51A.

(5) The driving member 50, which engages with the retention member 41 at the engaging groove 41A, moves the retention member 41 to the right, unplugging or removing the coaxial terminals 43 from the card terminals and spacing them from the side edge of the card C.

Figure 3:
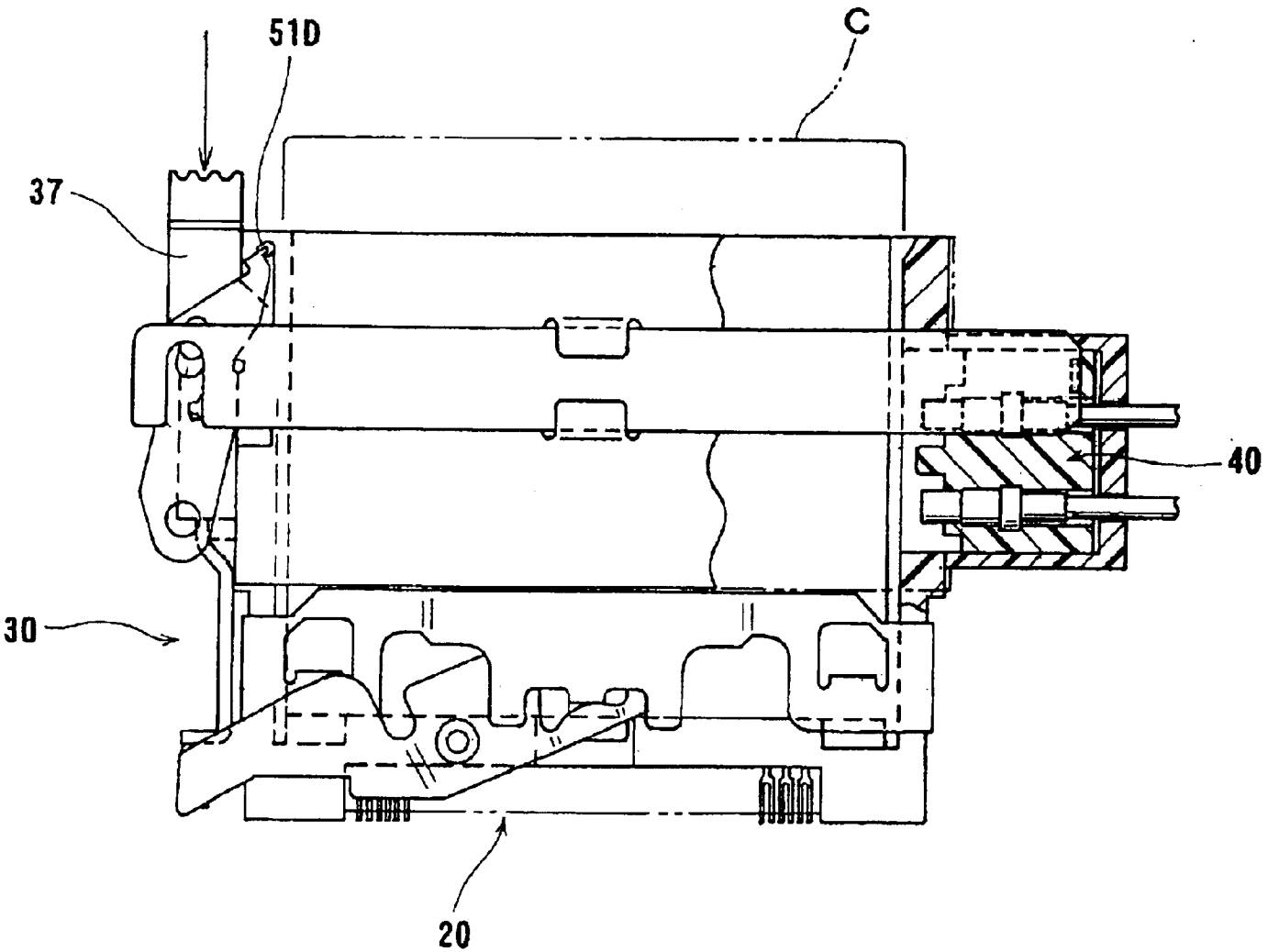
FIG. 3 is a plan view of the electrical connector apparatus in the card removal operation.

(6) Then, as shown in FIG. 3, the push button 37 is depressed to eject the card C from the front connector 20 by way of the ejector mechanism 30 so that the card C can be pulled out from the device. The stopper member 51D is out of the width of the card and the side connector 40 is spaced from the card, thus the card removal is made without any difficulty. The engagement between the U-shaped recess 52 of the driving member 50 and the axis 51A of the intermediate link 51 is detachable so that the front movement of the push rod 34 is unlimited.

(7) To insert a card, after a card C is inserted to connect with the front connector 20, the push button 37 is returned to the lateral position, thus making accidental removal of the card difficult. The driving member 50 is pulled to the left by way of the link mechanism so that the retention member 41 is moved in the same direction, thereby plugging or making connection by fitting the coaxial terminals 43 to the mating terminals of the card side. At this point, the projection 41B of the retention member 41 engages with the corresponding recess of the card C for positioning so that the connection by fitting of the coaxial terminals 43 is made always at the regular position in the card-inserting direction. At the same time, the stopper member 51D of the intermediate link 51 is located at the rear position of the card C, thus making the card removal impossible.

Figure 4:
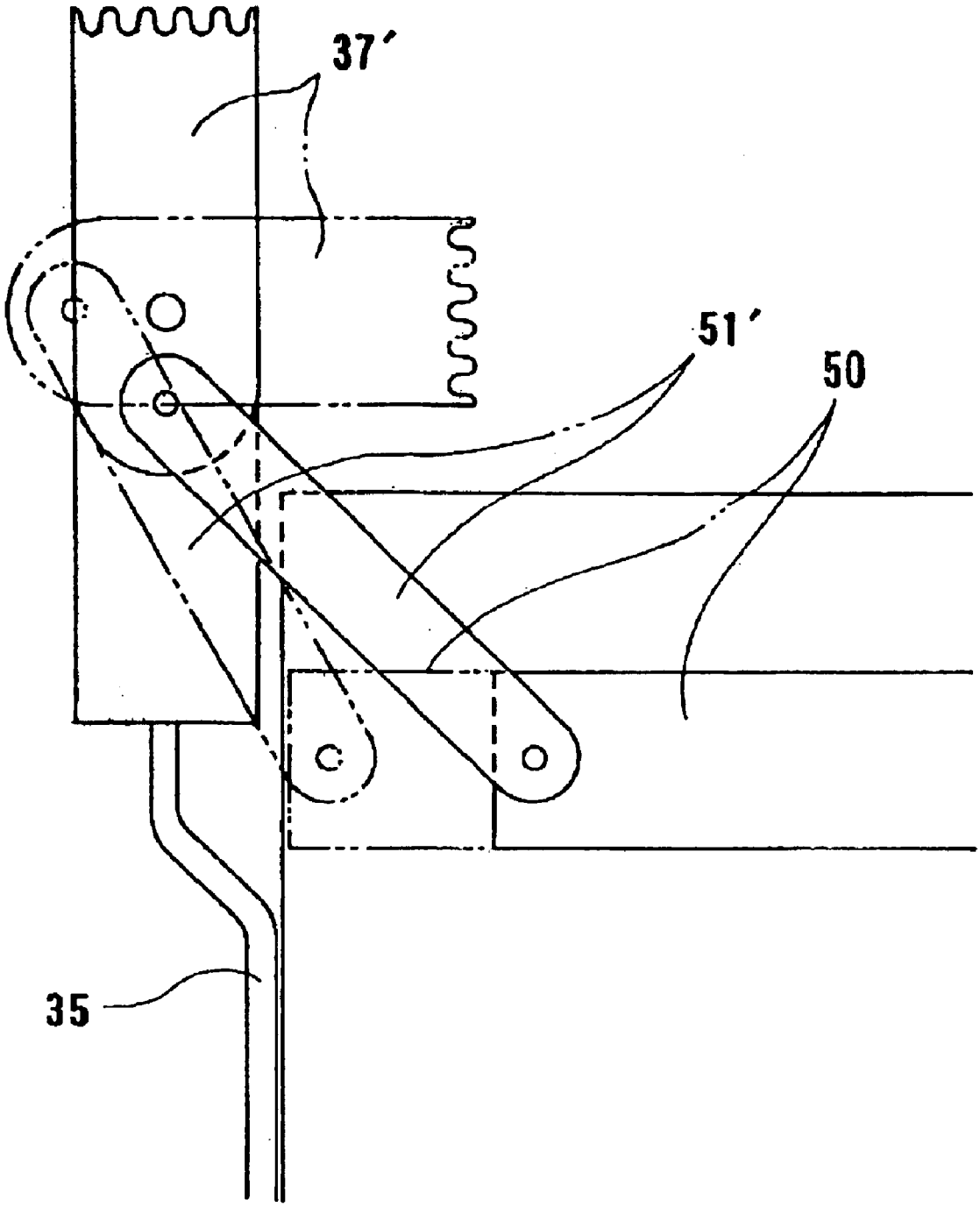
FIG. 4 is a plan view of part of an electrical connector apparatus according to the first modification of the first embodiment.

In FIG. 4, according to the first modification to the first embodiment, a push button 37' is turned to the lateral position shown by two-dot chain line to not only serve as a stopper member but also move the driving member 50 to the left with an intermediate link 51'.

Figure 5:
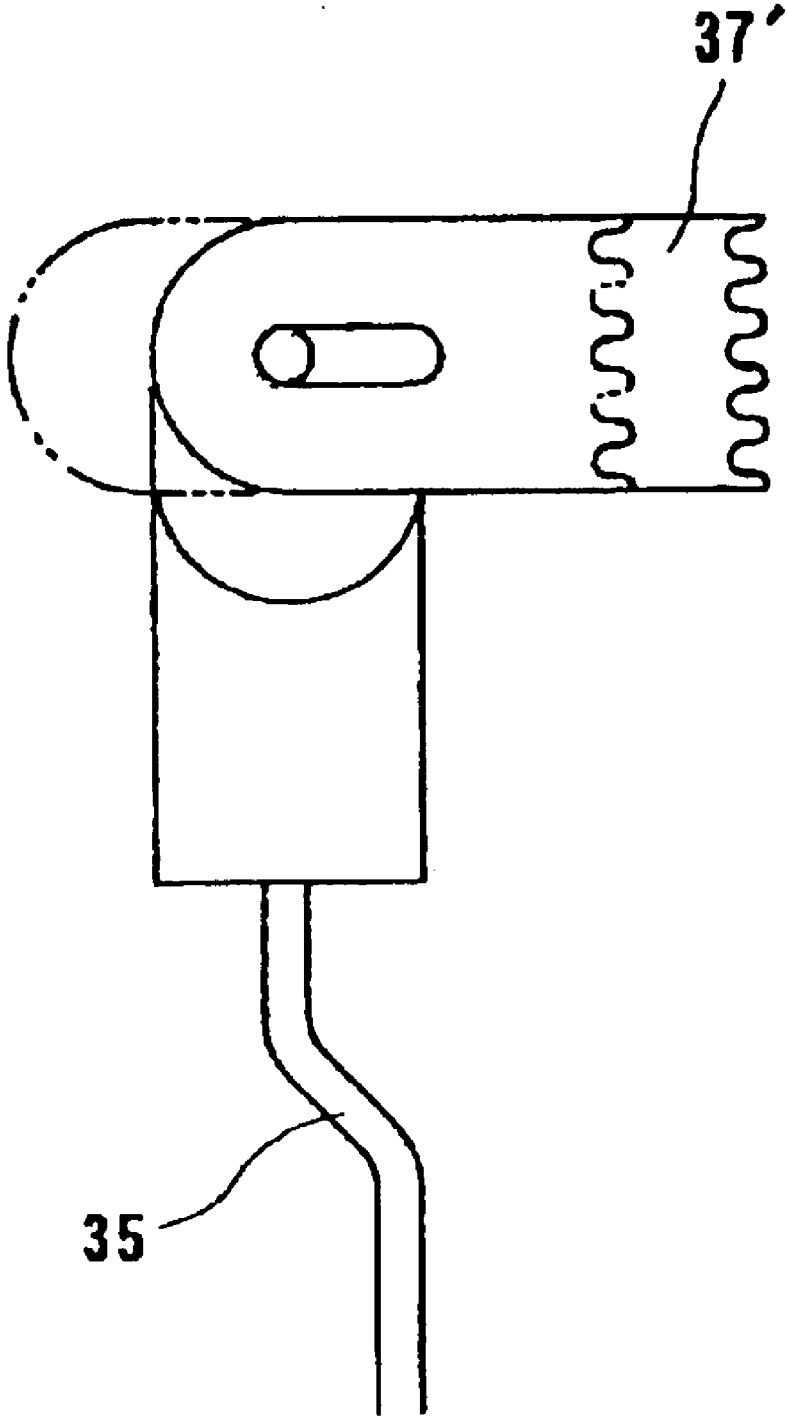
FIG. 5 is a plan view of part of an electrical connector apparatus according to the second modification of the first embodiment.

In FIG. 5, according to the second modification to the first embodiment, a push button 37" is turned to the right and then slid to the right as shown by solid line to serve as an improved stopper member.

Second Embodiment

Figure 6A:
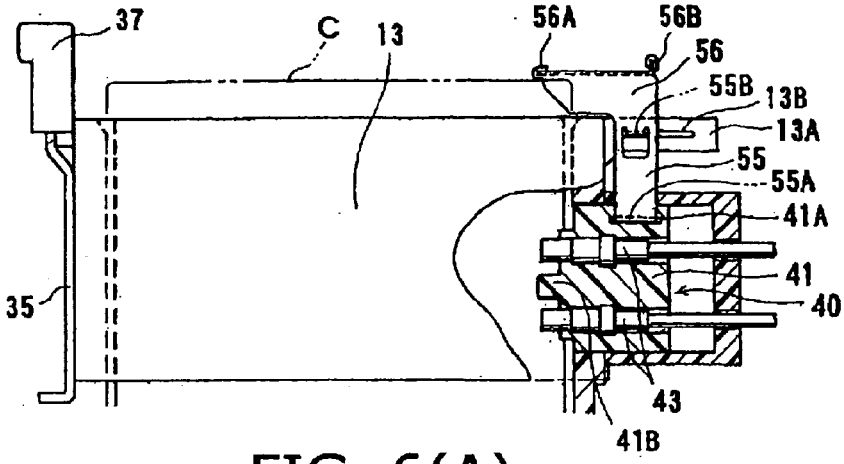
FIG. 6(A) is a plan view of an electrical connector apparatus according to the second embodiment of the invention under the card removal prohibited condition.

In FIG. 6(A), the push button 37 is connected directly to the rod section 35 to operate the ejector mechanism. The driving member 55 has an operation member 56 that is located outside the body of the electronics device for operation. The driving member 55 extends forwardly from the operation member 56 and has at its front end a bent claw 55A for engagement with the engaging groove 41A of a retention member 41. A guided claw 55B is provided by bending the middle portion of the driving member 55 for guiding by a guiding slot 13B provided in a guide piece 13A, thus assuring stable lateral movement of the driving member 55. The operation member 56 is provided with a stopper section 56A for interference with the end of a card C in the card-removing direction and an operation claw 56B for facilitating the operation of lateral movement of the operation member 56. The side connector is identical with that of FIG. 1 and its description will be omitted.

After a card C is inserted (and connected to the front connector), the operation member 56 is brought to the left hand position with the operation claw 56B as shown in FIG. 6(A). The stopper section 56A prevents accidental removal of the card, and the driving member 55 moves the retention member 41 to the left, engaging the projection 41B with the corresponding recess of the card so that the coaxial terminals 43 are connected by fitting to the corresponding terminals of the card at the regular position.

Figure 6B:
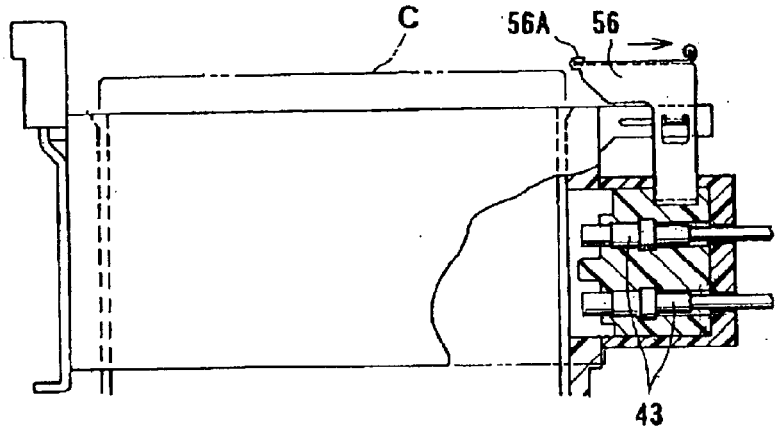
FIG. 6(B) is a plan view of the electrical connector apparatus under the card removal permitted condition.

To remove the card, the operation member 56 is moved to the right as shown in FIG. 6(B) to release the stopper member 56A and the coaxial terminals 43.

Figure 6C:
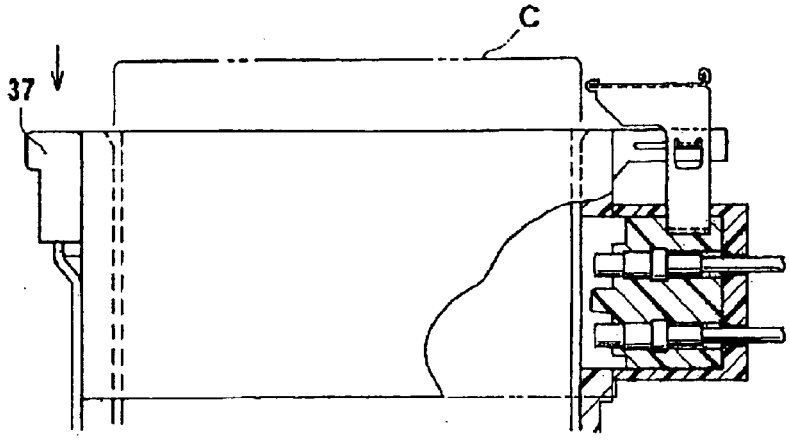
FIG. 6(C) is a plan view of the electrical connector apparatus during the card removal operation.

Then, as shown in FIG. 6(C), the push button 37 is depressed to operate the ejector mechanism for releasing the card from the front connector and moving it rearwardly. Thus, the rear end of the card can be grabbed to pull it out.

It is understood that various modifications are obvious to those having an ordinary skill in the art. The front terminals and the front connector are not essential and the side connector may be provided on the bottom or upper plate of the electronics device. The stopper member of FIG. 1 is not essential because removal of the card is difficult as long as the push button is at the second or lateral position. The stopper member may be provided at such a position as to engage with an engaging recess that is provided in a side edge of the card.

As has been described above, according to the invention, when the operation member is brought to the first position, it is possible to remove the card but, the operation member at the second position, the removal is either impossible or difficult. Thus, accidental removal of the card in use is prevented. Also, it is possible to connect by fitting the connector terminals to the card, thus preventing poor conduction under vibrations.

What is claim is:

1. A card electrical connector apparatus comprising:

a connector section electrically connectable to a card at a right angle with respect to a card insertion direction when said card is inserted completely into an electronics device through a receiving slot, said connector section slidable between a connection position a d a release position at right angles with respect to said card insertion direction;

a driving section linked to said connector section for moving said connector section at right angles with respect to said card insertion direction;

an operation section for operating said driving section from outside, said operation section movable between a first position where said card is allowed to be removed and a second position where removal of said card is either impossible or difficult, wherein when said operation section is at said first position, said driving section moves said connector section to said release position.

2. The card electrical connector apparatus according to claim 1, wherein when said operation section is at said second position, said driving section moves said connection section to said connection position.

3. The card electrical connector apparatus according to claim 1 or 2, wherein said operation section or a part of said operation section is at such a position as to interfere with said card in a card removing direction when said operation section is at said second position.

4. The card electrical connector apparatus according to claim 1 or 2, wherein said operation section also serves as a push button for operating an ejector mechanism that ejects said card from said receiving slot.

5. The card electrical connector apparatus according to claim 4, wherein said driving section is linked to said operation section so a to make a link mechanism and includes a stopper member that interferes with an rear end of said card so that when said operation section is moved from said second position to said first position, said stopper member is moved to a non-interference position and said driving section brings said connector section to said release position.

6. The card electrical connector apparatus according to claim 1 or 2, wherein said operation section is made integral with said driving section.

7. The card electrical connector apparatus according to claim 1 or 2, further comprising:

a pair of parallel guide members; and a front connector provided at front ends of said guide members and having at least one terminal for contact with said card inserted in said card insertion direction.

8. The card electrical connector apparatus according to claim 1 or 2, wherein said operation section is rotatable from said first to said second position.

9. The card electrical connector apparatus according to claim 4, wherein said operation section is rotatable from said first to said second position.

* * * * *